US006411794B1

(12) United States Patent
Muto

(10) Patent No.: US 6,411,794 B1
(45) Date of Patent: Jun. 25, 2002

(54) DISCHARGE DEVICE AND IMAGE FORMING APPARATUS

(75) Inventor: Kazufumi Muto, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/594,558

(22) Filed: Jun. 15, 2000

(30) Foreign Application Priority Data

Jun. 17, 1999 (JP) ..... 11-171045

(51) Int. Cl.[7] ..... G03G 15/00

(52) U.S. Cl. ..... 399/315; 250/325; 399/90; 399/170; 399/311

(58) Field of Search ..... 399/90, 315, 311, 399/170, 89; 361/225, 229, 235; 250/324, 325, 326

(56) References Cited

U.S. PATENT DOCUMENTS 2,863,063 A * 12/1958 Schulze ..... 250/325
4,307,431 A * 12/1981 Sone et al. ..... 399/170 X
4,466,729 A * 8/1984 Iwata ..... 399/311
5,381,216 A * 1/1995 Osaka et al. ..... 399/315

FOREIGN PATENT DOCUMENTS

JP 59-102258 * 6/1984

* cited by examiner

*Primary Examiner*—Sophia S. Chen
(74) *Attorney, Agent, or Firm*—Fitzpatrick, Cella, Harper & Scinto

(57) ABSTRACT

A discharge device has a discharge wire for discharge in response to a voltage, a supporting block for supporting the discharge wire, an electric contact receiving an AC voltage, and a resistor element placed between the discharge wire and the electric contact. The discharge device serves particularly as a separation charger of an image forming apparatus.

11 Claims, 4 Drawing Sheets

DISCHARGE DEVICE AND IMAGE FORMING APPARATUS

BACKGROUND OF THE INVENTION

1. Field of the Invention

The present invention relates to a discharge device and image forming apparatuses, such as copying machines and printers, using a discharge device.

2. Description of the Related Art

FIG. 5 is a cross-sectional view of a copying machine of the electrophotographic type.

As FIG. 5 shows, an electrostatic image is formed on the surface of a photosensitive drum 104 through the use of an optical unit 103, an electrifying device 203 and other components and, subsequently, a toner serving as a developer is attached to the electrostatic image by means of a developing device 201 so that the electrostatic image develops into a visible image. Additionally, this visible image is transferred through a transferring device 111 onto a transfer material conveyed by feeding means 105 to 110 and the transfer material with the visible image on it is separated from the photosensitive drum 104 by a separating device 112 and subsequently conveyed by a conveying means 113 to a fixing device 114 where it is heated and pressurized to fix the visible image. The transfer material on which the visible image has been fixed is ejected outside of the copying machine through an ejecting device 116.

Meanwhile, if a paper jam occurs during an image forming operation, the removal of the jammed paper becomes necessary. In addition, a need for periodical apparatus-interior maintenance exists. Therefore, for easy jam elimination and maintenance, there has been proposed a construction in which a section indicated by a broken line in FIG. 5 is made as a single fixing/conveying unit 300 and this fixing/conveying unit 300 is drawable toward the front side of the image forming apparatus along a guide rail (not shown).

In this construction, the fixing/conveying unit 300 includes the transferring device 111 and the separating device 112, which each require a high-voltage contact for its power supply. For the unit configuration, the high-voltage contact is disposed in the vicinity of either the transferring device 111 or the separating device 112 and at a position where the connection with the main body is facilitated. Taking this into consideration, the high-voltage contact is positioned on the rear surface of the transferring device 111 and the separating device 112, that is, on the rear surface of the fixing/conveying unit 300.

Furthermore, an AC voltage is to be applied to the separating device 112. The electrifying device, thus designed to use an AC voltage, tends to generate radiation noise.

FIG. 6 is an enlarged cross-sectional view showing a high-voltage contact section for the separating device 112 in the image forming apparatus of FIG. 5.

As FIG. 6 shows, the high-voltage contact section for the separating device 112 in the image forming apparatus is composed of a separating device contact portion 51, a separating device block 52, a spring latching plate 55, a main body contact 61, a main body contact block 62, a base plate contact 61 and a main body frame 70.

The high-voltage contact section for the separating device 112 is constructed in a manner that the separating device contact portion 51 is inserted into a cylindrical portion 52*a* of the separating device block 52 and secured to a spring latch 55. Additionally, an electrifying wire (not shown) is attached through a spring 56 to the spring latch 55 to establish the electrical connection.

On the other hand, in the contact section on the image forming apparatus main body side, the main body contact 61 and the base plate contact 63 are attached to the main body contact block 62, with them being connected electrically to each other. Additionally, the base plate contact 63 is connected to a main body high-voltage base plate (not shown), while the main body contact block 62 is attached to the main body frame 70.

The separating device contact portion 51 is brought into contact with the main body contact 61, the latter made with an elastic material, thereby establishing electrical connection therebetween. A high AC voltage generated from a main body high-voltage base plate (not shown) is supplied to the base plate contact 63, the main body contact 61 and the separating device contact portion 51 so that the electrifying wire (not shown) produces corona discharge, thereby accomplishing separation of a transfer material.

While the separating device 112 conducts the separating operation, a radiation noise may occur at the high-voltage contact section.

If a right-hand area of the main body frame 70 is exterior to the apparatus, the radiation noise tends to leak toward the exterior of the apparatus. For this reason, a shielding mechanism is required to prevent the leakage of the radiation noise.

SUMMARY OF THE INVENTION

Accordingly, it is an object of the present invention to provide an image forming apparatus capable of reducing noises to be radiated to the external.

Another object of this invention is to provide a discharge device capable of reducing radiation noise at a high-voltage contact section.

In accordance with these objects, there is provided a discharge device comprising a discharging unit, a supporting member for supporting the discharging unit, and an electrifying device contact portion. A resistor element is placed between the discharging unit and the electrifying device contact portion.

In accordance with another aspect of the invention there is provided an image forming apparatus with an image forming unit having a high-voltage component. An AC base plate communicates power to the high-voltage component of the image forming unit thru a main body contact and an attachable/detachable high-voltage contact section. The high-voltage contact section includes a discharging unit, a supporting member for supporting the discharging unit, an electrifying device contact portion in contact with the main body contact and a resistor element placed between the discharging unit and the electrifying device contact portion.

Other objects of the present invention will become more readily apparent from the following description.

DESCRIPTION OF THE PREFERRED EMBODIMENTS

Embodiments of the present invention will be described hereinbelow with reference to the accompanying drawings.

(First Embodiment)

Figure 1:
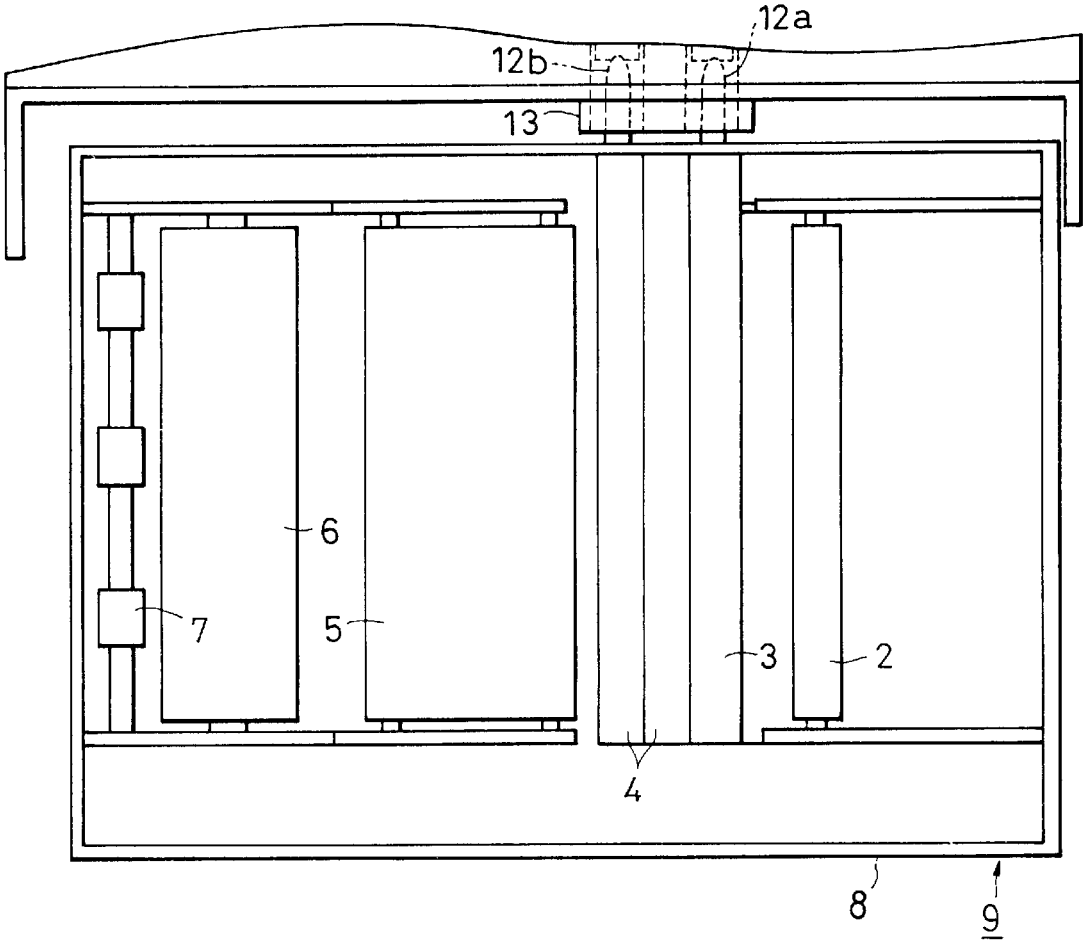
FIG. 1 is a plan view showing a fixing/conveying unit of an image forming apparatus according to a first embodiment of the present invention.
Figure 2:
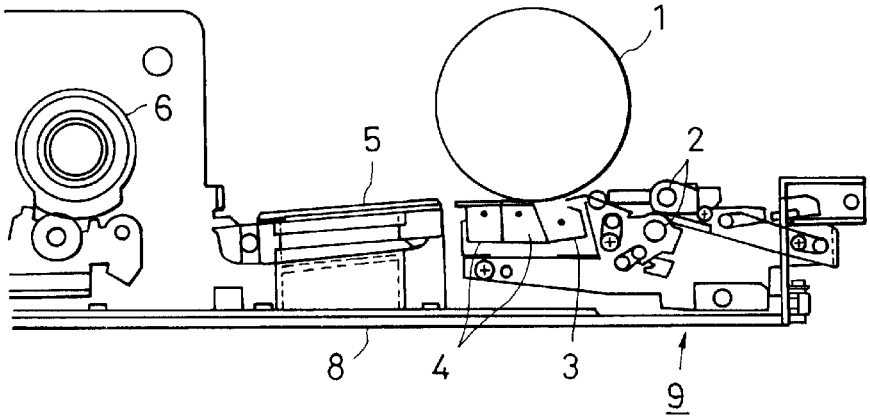
FIG. 2 is a cross-sectional view showing the fixing/conveying unit of the image forming apparatus according to the first embodiment of this invention.
Figure 3:
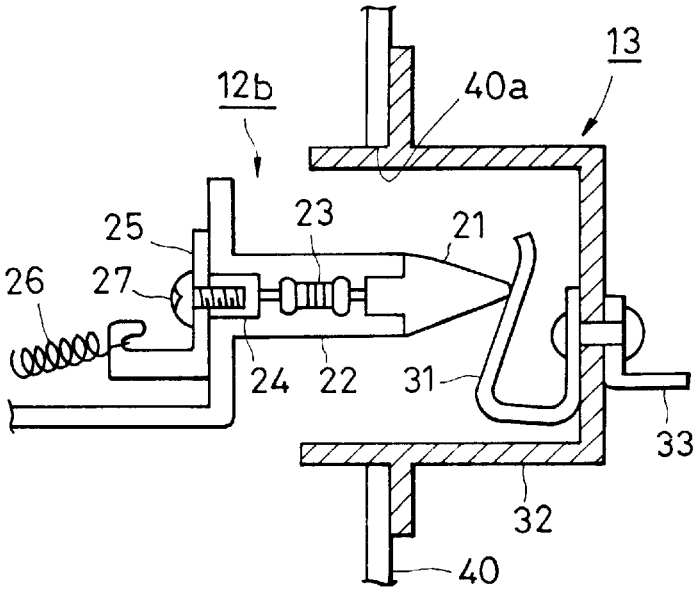
FIG. 3 is an enlarged cross-sectional view showing a high-voltage contact section of the image forming apparatus according to the first embodiment of this invention.

FIG. 1 is a plan view showing a fixing/conveying unit of an image forming apparatus according to a first embodiment of the present invention, FIG. 2 is a cross-sectional view of the fixing/conveying unit of FIG. 1, and FIG. 3 is an enlarged cross-sectional view showing a high-voltage contact section thereof.

In the image forming apparatus according to this embodiment, a photosensitive drum 1 carries a toner image developed by a developing device (not shown) and, subsequently, the toner image carried on the photosensitive drum 1 is transferred to a transfer material by an operation of a transfer electrifying device 3. Furthermore, a pair of register rollers 2 convey the transfer material to the toner image on the photosensitive drum 1, and the transfer electrifying device 3 transfers the toner image on the photosensitive drum 1 onto that transfer material.

The transfer material having thereon the toner image is separated from the photosensitive drum 1 by means of a separation rectifying device 4 and is then conveyed to a pair of fixing rollers 6 through a conveying belt 5. The fixing roller r pair 6 fix the toner image on the transfer material, following which the transfer material is ejected to the external through the use of a pair of ejecting rollers 7.

In this composition, the register roller pair 2, the transfer electrifying device 3, the separation electrifying device 4, the conveying belt 5, the fixing roller pair 6 and the ejecting roller pair 7 are all fixed on a unit base plate 8, and are constructed as a fixing/conveying unit 9 to be attachable/detachable simultaneously to/from the main body of the image forming apparatus. The transfer electrifying device 3 and the separation electrifying device 4 of this fixing/conveying unit 9 are equipped with high-voltage contact sections 12*a* and 12*b*, respectively (see FIG. 1). When the fixing/conveying unit 9 is mounted on the image forming apparatus main body, the high-voltage contact sections 12*a* and 12*b* are brought into contact with a main body contact section 13 so that the transfer electrifying device 3 and the separation electrifying device 4 receive a power supply.

In this embodiment, since radiation noise develops in the separation electrifying device 4 for supplying a high AC voltage, the high-voltage contact section for the separation electrifying device 4 in the image forming apparatus are constructed as shown in FIG. 3.

As FIG. 3 shows, the high-voltage contact section for the separation electrifying device 4 in the image forming apparatus is made up of a separation electrifying device contact portion 21, a separation electrifying device block 22, a resistor 23, a connecting portion 24, a spring latching plate 25, a main body contact 31, a main body contact block 32, a base plate contact 33 and a main body frame 40.

The high-voltage contact section 12b of the separation electrifying device 4 is constructed with the separation electrifying device contact portion 21, the resistor 23 and the connecting portion 24 embedded in the separation electrifying device block 22, and the separation electrifying device contact portion 21, the resistor 23 and the connecting portion 24 are connected electrically to each other. Additionally, the spring latching plate 25 is attached through a screw 27 to the connecting portion 24. Incidentally, it is also appropriate that the connecting portion 24 and the spring latching plate 25 are constructed as an integrated unit.

In addition, an electrifying wire (not shown) is attached through a spring 26 to the spring latching plate 25 to establish an electrical connection.

On the other hand, in the main body high-voltage contact section 13 of the image forming apparatus, the main body contact 31 made from a metallic elastic material and the base plate contact 33 are attached to the main body contact block 32, with the main body contact 31 and the base plate contact 33 connected electrically to each other. The base plate contact 33 is also connected to a main body high-voltage base plate (not shown), while the main body contact block 32 is fit into an opening portion 40*a*, made in a rear surface of the main body frame 40, to be set thereat.

The separation electrifying device contact portion 21 is inserted into the opening portion 40*a* made in the rear surface of the main body frame 40 and is brought into contact with the main body contact 31, situated on the rear surface of the main body frame 40, to establish electrical connection between separation electrifying device contact portion 21 and main body contact 31. A high AC voltage generated from a main body pressing base plate (not shown) is supplied to the base plate contact 33, the main body contact 31 and the separation electrifying device contact portion 21 in this order so that the electrifying wire (not shown) performs the corona discharge, that is, conducts the transfer material separating operation. The separation electrifying device contact portion 21 is formed into a conical configuration. The reason for a conical configuration is that when the fixing/conveying unit 9 is mounted in the image forming apparatus in a state where the transfer material is left in error after a jam handling operation or the like, there is the possibility of a fire if the transfer material is put between the separation electrifying device contact portion 21 and the main body contact 31. Accordingly, to prevent this, the separation electrifying device contact portion 21 is made pointed so as to break through the transfer material and, further, to come into contact with the main body contact 31 for securing the electrical connection.

While the separation electrifying device 4 conducts the separating operation, a radiation noise occurs in the high-voltage contact section and, if the right-hand area of the main body frame 40 is designed to be exterior of the apparatus, then this creates an apparatus radiation noise problem. However, in this embodiment, the resistor 23 is placed in the left-hand area (the front side of the opening portion 40*a* of the main body frame 40) with respect to the vicinity of the main body frame 40 and the power load such as the corona discharge is disposed downstream, which reduces the radiation noise occurring in the high-voltage contact section so that the radiation noise occurring on the right side of the main body frame 40 is reduced. That reduction effect was as much as 10 dB or more, and it was confirmed that this arrangement functions sufficiently as a countermeasure against the radiation noise.

(Second Embodiment)

Figure 4:
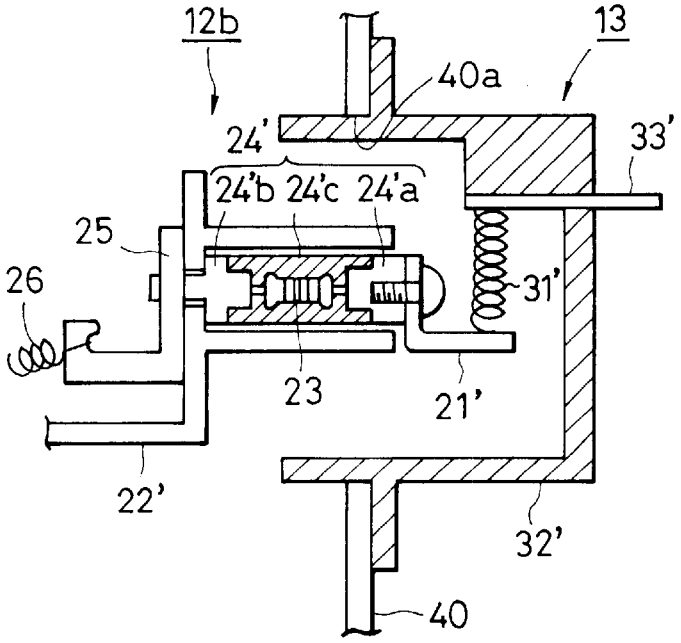
FIG. 4 is an enlarged cross-sectional view showing a high-voltage contact section of an image forming apparatus according to a second embodiment of this invention.
Figure 5:
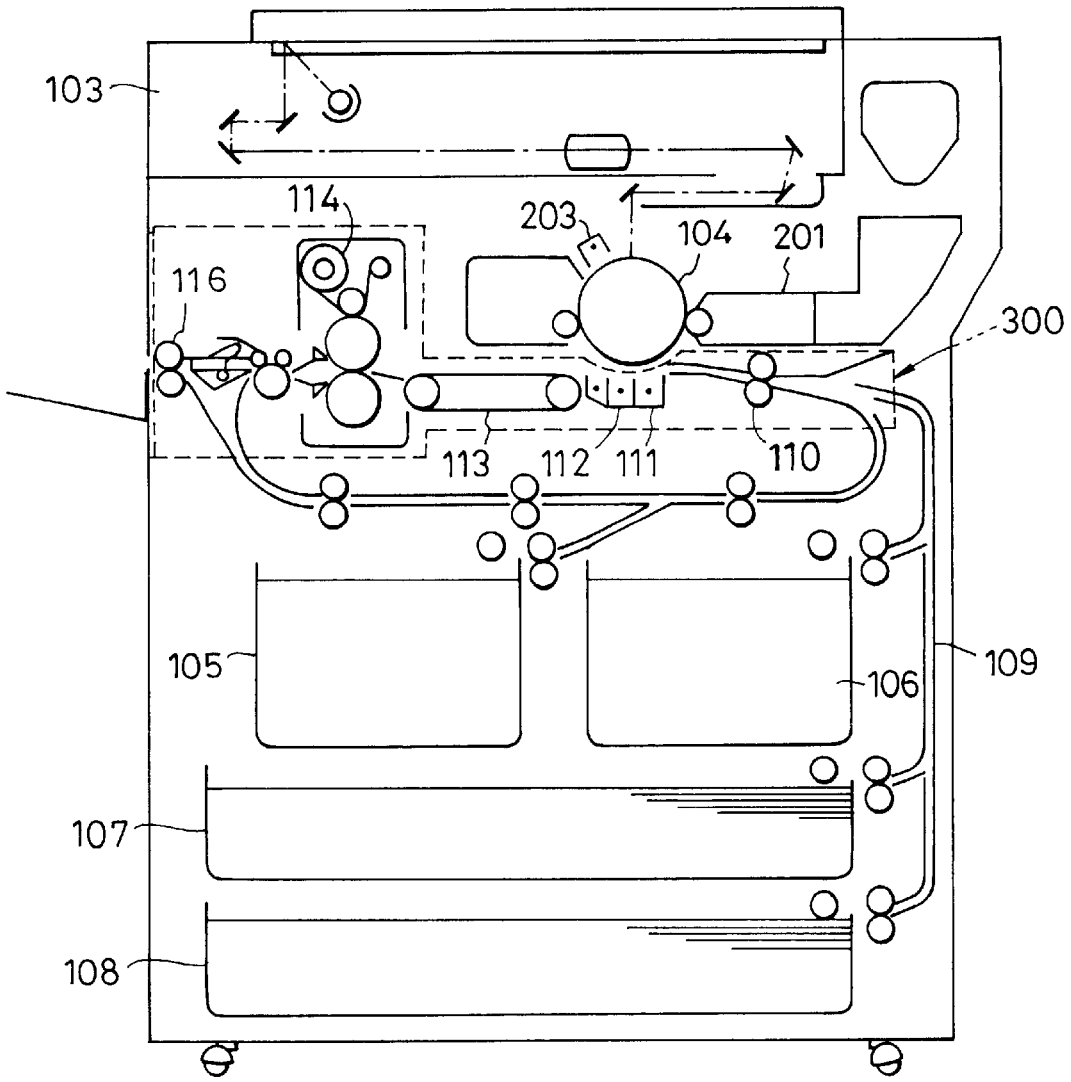
PRIOR ART FIG. 5
FIG. 5 is a cross-sectional view showing an image forming apparatus.
Figure 6:
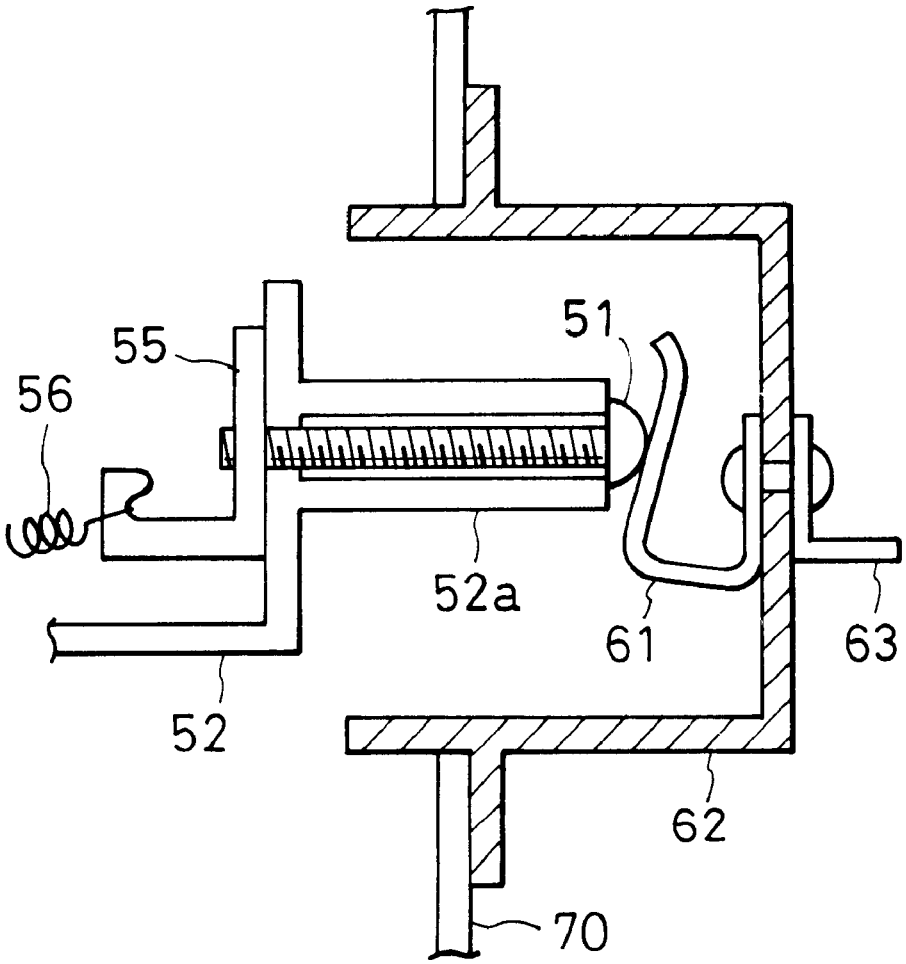
PRIOR ART FIG. 6
FIG. 6 is an enlarged cross-sectional view showing a high-voltage contact section of the image forming apparatus.

Referring to FIG. 4, a description will be given hereinbelow of a second embodiment of this invention.

FIG. 4 is an enlarged cross-sectional view showing a high-voltage contact section for a separation electrifying device 4 in an image forming apparatus according to this embodiment.

In this embodiment, the high-voltage contact section 12*b* for the separation electrifying device 4 in the image forming apparatus is composed of a separation electrifying device contact portion 21', a separation electrifying device block 22', a resistor 23, a connecting portion 24', a spring latching plate 25, a main body contact 31', a main body contact block 32', a base plate contact 33' and a main body frame 40.

In the high-voltage contact section 12*b* for the separation electrifying device 4, the separation electrifying device contact portion 21' and the spring latching plate 25 are fit through the connecting portion 24' to the separation electrifying device block 22'. The connecting portion 24' is constructed such that metallic ping 24'*a* and 24'*b* are connected to the resistor 23 and a mold 24'*c* is put around them to form a cylindrically embedded configuration.

The separation electrifying device contact portion 21', the resistor 23 and the spring latching plate 25 are connected electrically to each other, and an electrifying wire (not shown) is attached through a spring 26 to the spring latching plate 25 to establish electrical connection.

On the other hand, in the main body high-voltage contact section 13 of the image forming apparatus, the main body contact 31' made from a metallic elastic material is attached to the base plate contact 33', and the base plate contact 33' is attached to the main body contact block 32'. The main body contact 31' and the base plate contact 33' are connected electrically to each other, while the base plate contact 33' is connected to a main body high-voltage base plate (not shown). Additionally, the main body contact block 32' is fitted in an opening portion 40*a*, made in a rear surface of the main body frame 40, to be set thereat.

The separation electrifying device contact portion 21' is inserted into the opening portion 40*a* made in the rear surface of the main body frame 40 and is brought into contact with the main body contact 31' situated on the rear surface of the main body frame 40 to establish an electrical connection therebetween. A high AC voltage generated from a main body pressing base plate (not shown) is supplied to the base plate contact 33', the main body contact 31' and the separation electrifying device contact portion 21' so that the electrifying wire (not shown) performs the corona discharge to conduct the transfer material separating operation.

This embodiment is characterized in that the connecting portion 24' is made to be attachable/detachable with respect to the separation electrifying device block 32'. This is because, taking into consideration a radiation noise countermeasure in the image forming apparatus, easy changing of the resistor 23 allows a wider range of applications. The frequency of the radiation noise can vary according to the using condition of the image forming apparatus. At this time, if the resistor 23 is embedded in the separation electrifying device block 32' as well an the above-described first embodiment, the image forming apparatus requires a new mold for the separation electrifying device block 32 at every specification.

Accordingly, in this embodiment, since the connecting portion 24' is detachable, when a need for changing of the type of the resistor 23 arises, the alteration can be confined to a minimum. Thus, this construction can flexibly cope with various specifications. Also in this embodiment, it was confirmed that sufficient effects are attainable for the reduction of radiation noise.

It should be understood that the foregoing relates to only preferred embodiments of the present invention, and that it is intended to cover all changes and modifications of the embodiments of the invention herein used for the purpose of the disclosure, which do not constitute departures from the spirit and scope of the invention. For example, although the above description of the embodiments have been made in conjunction with a separation electrifying device of an image forming apparatus, this invention is also applicable to other discharge devices receiving supply of an AC voltage.

What is claimed is:

1. A discharge device comprising:

a discharging wire;

a supporter member for supporting said discharging wire;

an electrifying device contact portion; and a resistor element placed between said supporter member and said electrifying device contact portion.

2. A discharge device according to claim 1, wherein an AC voltage is applied to said electrifying device contact portion.

3. A discharge device according to claim 1, wherein said electrifying device contact portion has a conical shape and is adapted for contact with a conductive elastic member.

4. A discharge device according to claim 1, wherein said resistor element is attachable to and detachable from said supporter member.

5. An image forming apparatus comprising:

an AC base plate;

a main body contact connected to said AC base plate;

a frame installed on a rear side of a main body of said image forming apparatus; and an attachable/detachable discharging means, comprising:

a discharging member;

a supporter member for supporting said discharging member;

an electrifying device contact portion in contact with said main body contact; and a resistor element placed between said discharging member and said electrifying device contact portion, wherein said main body contact is disposed exterior to said frame.

6. An image forming apparatus according to claim 5, wherein said frame has an opening portion for enabling contact of said electrifying device contact portion with said main body contact with said discharging means is mounted.

7. An image forming apparatus according to claim 5, wherein said resistor element is disposed interior of said frame.

8. An image forming apparatus according to claim 5, further comprising a separation rectifying device, wherein an AC voltage is applied to the separation rectifying device through a discharge wire.

9. An image forming apparatus according to claim 5, wherein said main body contact is a conductive elastic member.

10. An image forming apparatus according to claim 5, wherein said resistor element is attachable to and detachable from said supporter member.

11. An image forming apparatus according to claim 5, wherein an image forming unit is contained within the frame and said image forming unit comprises an image carrier for carrying a toner image and transfer means for transferring said toner image on said image carrier to a transfer material, and wherein said attachable/detachable discharging means conducts electrification elimination of said transfer material after the transferring.

* * * * *

UNITED STATES PATENT AND TRADEMARK OFFICE

CERTIFICATE OF CORRECTION

PATENT NO. : 6,411,794 B1
DATED : June 25, 2002
INVENTOR(S) : Kazufomi Muto

It is certified that error appears in the above-identified patent and that said Letters Patent is hereby corrected as shown below:

Column 3,
Line 34, "r" should be deleted.

Column 6,
Line 43, "with" should read -- wherein --.

Signed and Sealed this

Twenty-ninth Day of October, 2002

*Attest:*

*Attesting Officer*

JAMES E. ROGAN
*Director of the United States Patent and Trademark Office*